US010898049B2

(12) United States Patent
Boguslavschi et al.

(10) Patent No.: US 10,898,049 B2
(45) Date of Patent: Jan. 26, 2021

(54) CLEANING DEVICE AND METHODS OF MANUFACTURING THEREOF

(71) Applicant: Global Industry Products, Corp., Las Vegas, NV (US)

(72) Inventors: Nicolai Boguslavschi, Chişinău (MD); David Braylyan, Cheshire, CT (US); Chester Ivan Wright, Las Vegas, NV (US); Arkady Zalan, Henderson, NV (US)

(73) Assignee: Global Industry Products, Corp., Las Vegas, NV (US)

( * ) Notice: Subject to any disclaimer, the term of this patent is extended or adjusted under 35 U.S.C. 154(b) by 148 days.

(21) Appl. No.: 15/921,171

(22) Filed: Mar. 14, 2018

(65) Prior Publication Data

US 2019/0282057 A1 Sep. 19, 2019

(51) Int. Cl.
*A47L 13/17* (2006.01)
*A47L 13/30* (2006.01)

(52) U.S. Cl.
CPC ..... *A47L 13/17* (2013.01); *A47L 13/30* (2013.01)

(58) Field of Classification Search
CPC ..... A47L 13/17
See application file for complete search history.

(56) References Cited

U.S. PATENT DOCUMENTS 4,780,361 A * 10/1988 Schlein ..... A47L 13/16 442/374
4,820,579 A * 4/1989 Aszman ..... C11D 17/049 428/304.4
7,962,993 B2 * 6/2011 Glaug ..... A47L 13/20 15/118
8,337,110 B2 * 12/2012 Rees ..... A47L 13/17 15/104.93
2005/0136238 A1 * 6/2005 Lindsay ..... A47L 13/16 428/304.4
2005/0244211 A1 * 11/2005 Brunner ..... A47L 13/17 401/132
2005/0244212 A1 * 11/2005 Brunner ..... A47L 13/17 401/196
2018/0160873 A1 * 6/2018 Song ..... A47L 13/17
2018/0160874 A1 * 6/2018 Song ..... A47L 13/256

* cited by examiner

*Primary Examiner* — Michael D Jennings
(74) *Attorney, Agent, or Firm* — IRL Legal Services, LLC; Ilya R. Lapshin

(57) ABSTRACT

A cleaning sponge that efficiently utilizes melamine to effectively remove dirt and contaminants from a surface. The cleaning sponge includes a first sponge layer, a second sponge layer, a solidified detergent layer, a plurality of first pores, a plurality of second pores, and a plurality of third pores. The first sponge layer and the second sponge layer are connected to the solidified detergent layer on either side and provide protection for the solidified detergent layer against degradation. The plurality of first pores is distributed throughout the first sponge layer. The plurality of second pores is distributed throughout the second sponge layer. The plurality of third pores is distributed throughout the solidified detergent layer. The plurality of first pores and the plurality of second pores are in fluid communication with each other through the plurality of third pores. Water may flow through the cleaning sponge to create an effective surfactant.

26 Claims, 6 Drawing Sheets

DETAIL A

DETAIL B

CLEANING DEVICE AND METHODS OF MANUFACTURING THEREOF

FIELD OF THE INVENTION

The present invention relates generally to cleaning devices. Embodiments of the present invention include a sponge with a melamine core designed to clean a variety of surfaces. The moistened sponge due to melamine's cleaning properties can be used without any additional detergent. The substances removed from the cleaned surface include fat, ink, and other kinds of liquids and solids.

BACKGROUND OF THE INVENTION

Melamine is a safe substance for mammals: its median lethal dose, by oral administration, in rats is 3.16 g/kg, i.e. the melamine is less toxic than table salt. According to data published by the International Program on Chemical Safety, melamine is not metabolized, is rapidly excreted in the urine, and is not irritating to the skin (tested on guinea pigs and rabbits) or to the mucous membranes of the eye (tested on rabbits). Additionally, no genetic toxicity was revealed in in-vivo tests. No carcinogenic properties had been identified when melamine was tested in mice.

The cleaning properties of melamine sponges are due to the fact that melamine dissolved in water is a highly effective surfactant which reduces the adhesion of contaminants to the substrate and emulsifies them. The contaminants are then removed together with traces of melamine during rinsing, not absorbed by the sponge. The concentration of melamine in the water accumulated within a soaked sponge is substantially small as melamine is quite difficult to dissolve in water: solubility of 0.0034 g/ml at water temperature of 20° C., 0.0074 g/ml at 40° C., 0.0149 g/ml at 60° C., 0.0275 g/ml at 80° C., and 0.0478 g/ml at 100° C. Therefore, it can be confidently asserted that the use of melamine-based sponges for dishwashing or cleaning of toys is completely harmless.

However, melamine-based sponges have a drawback: a relatively low strength when exposed to water. When in use, the sponge degrades fast as a result of its dissolution and the mechanical stresses associated with cleaning processes. Therefore, the service lifetimes of traditional melamine-based sponges are low.

Various features and modifications have been proposed against premature failure for melamine-based sponges. One approach utilizes a fabric sack to enclose the melamine and thus prevent mechanical action on the melamine. This does not solve the problem completely as it does not take into consideration rubbing of the melamine against the sack. This abrasion may be minimal initially but substantially increases during operations and causes melamine degradation.

Another approach includes using two layers of polyurethane foam glued onto either side of the melamine to protect it from mechanical impact during cleaning processes. While this solution eliminates the mechanical impact on the melamine, it reduces the effective cleaning properties of the sponge because of low solubility of melamine in water. When the sponge is submerged in water, or otherwise moisturized, the detergent solution produced by the dissolved melamine remains inside the sponge, does not reach the external surfaces of the sponge, and therefore does not engage the contaminated surface.

SUMMARY OF THE INVENTION

An example embodiment comprises: a melamine sponge core comprising pores; a work layer comprising pores; and a moisturizing layer; wherein the work layer is a large-pore flexible sponge made, for example, of polyurethane foam or rubber foam; wherein the pores in the work layer are connected to the pores in the melamine core; wherein a size of the pores in the work layer is at least 3 times and at most 20 times greater than a size of the pores in the melamine core; and wherein a thickness of the core is between 100% and 250% of a thickness of the work layer.

In some embodiments, the moisturizing layer and the work layer are manufactured of the same material; and wherein the moisturizing layer has a distinct color.

In some embodiments, the moisturizing layer is made of a fibrous material filled with abrasive particles; and wherein the moisturizing layer is used both for introducing water into the core and as a heavy-duty work layer.

In some embodiments, the moisturizing layer is an integral or a separable handle made of a solid plastic comprising a water reservoir; and wherein the surface of the moisturizing layer in contact with the melamine core comprises at least one outlet for transmitting water.

Another example embodiment comprises: applying an adhesive to contact surfaces; assembling the layers; and keeping the layers under pressure until the adhesive is solidified; wherein the glue is one of a plurality of water-soluble adhesives based on a synthetic rubber, for example a chloroprene rubber; wherein the applying is performed using a roller; wherein the adhesive is applied to a contact surface of each layer, then the surface is exposed until an adhesive film is divided into a plurality of droplets, then the layers are assembled into a package and kept under pressure; wherein the pressure is changed according to the flattening of the package; wherein the pressure is determined experimentally for each combination of layer materials.

In some embodiments, the detergent layer comprises the melamine sponge core is inside the moisturizing layer.

In some embodiments, the melamine sponge core and the moisturizing layer are fused.

Another example embodiment comprises: a detergent layer; a plurality of detergent layer pores distributed throughout the detergent layer; a work layer attached to the detergent layer; a plurality of work layer pores distributed throughout the work layer; wherein the plurality of work layer pores and the plurality of detergent layer pores are in fluid communication with each other; and wherein a pore size for each of the plurality of work layer pores is larger than a pore size for each of the plurality of detergent layer pores.

In some embodiments, the detergent layer comprises melamine.

In some embodiments, a pore size for each of the plurality of work layer pores is at least three times larger than a pore size for each of the plurality of detergent layer pores.

In some embodiments, the work layer comprises non-woven fibrous material.

In some embodiments, the work layer comprises polyurethane, polyurethane foam, or rubber foam.

In some embodiments, the work layer is abrasive or comprises abrasive particles.

In some embodiments, the work layer comprises a convoluted exterior surface.

In some embodiments, the work layer is flexible.

In some embodiments, a thickness of the detergent layer is from 100% to 250% of a thickness of the work layer.

Some embodiments further comprise a first plurality of adhesive droplets between the detergent layer and the work layer.

Some embodiments further comprise a moisturizing block attached to the detergent layer opposite the work layer; wherein the moisturizing block is capable of storing fluid; and wherein the moisturizing block and the plurality of work layer pores are in fluid communication through the plurality of detergent pores.

In some embodiments, the moisturizing block comprises a fluid reservoir; wherein a surface of the moisturizing block facing the detergent layer comprises at least one fluid outlet capable of transmitting fluid from the fluid reservoir; and wherein the fluid outlet and the plurality of work layer pores are in fluid communication through the plurality of detergent pores.

In some embodiments, the moisturizing block comprises a plurality of moisturizing block pores distributed throughout the moisturizing block; wherein the plurality of moisturizing block pores and the plurality of work layer pores are in fluid communication through the plurality of detergent pores.

In some embodiments, a pore size for each of the plurality of moisturizing block pores is larger than a pore size for each of the plurality of detergent pores.

In some embodiments, the work layer comprises polyurethane, polyurethane foam, or rubber foam.

In some embodiments, the moisturizing block and the work layer have different visual appearance.

In some embodiments, a second plurality of adhesive droplets between the detergent layer and the moisturizing block.

In some embodiments, the moisturizing block is abrasive or comprises abrasive particles.

Another example embodiment comprises: applying an adhesive layer to at least one of: a surface of the work layer facing the detergent layer, and a surface of the detergent layer facing the work layer; waiting for the adhesive layer to transform into a plurality of adhesive droplets; and pressing the facing surfaces of the work layer and the detergent layer to each other.

In some embodiments, the adhesive layer comprises a water dispersible adhesive.

In some embodiments, the adhesive layer is applied with a roller.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

Figure 1:
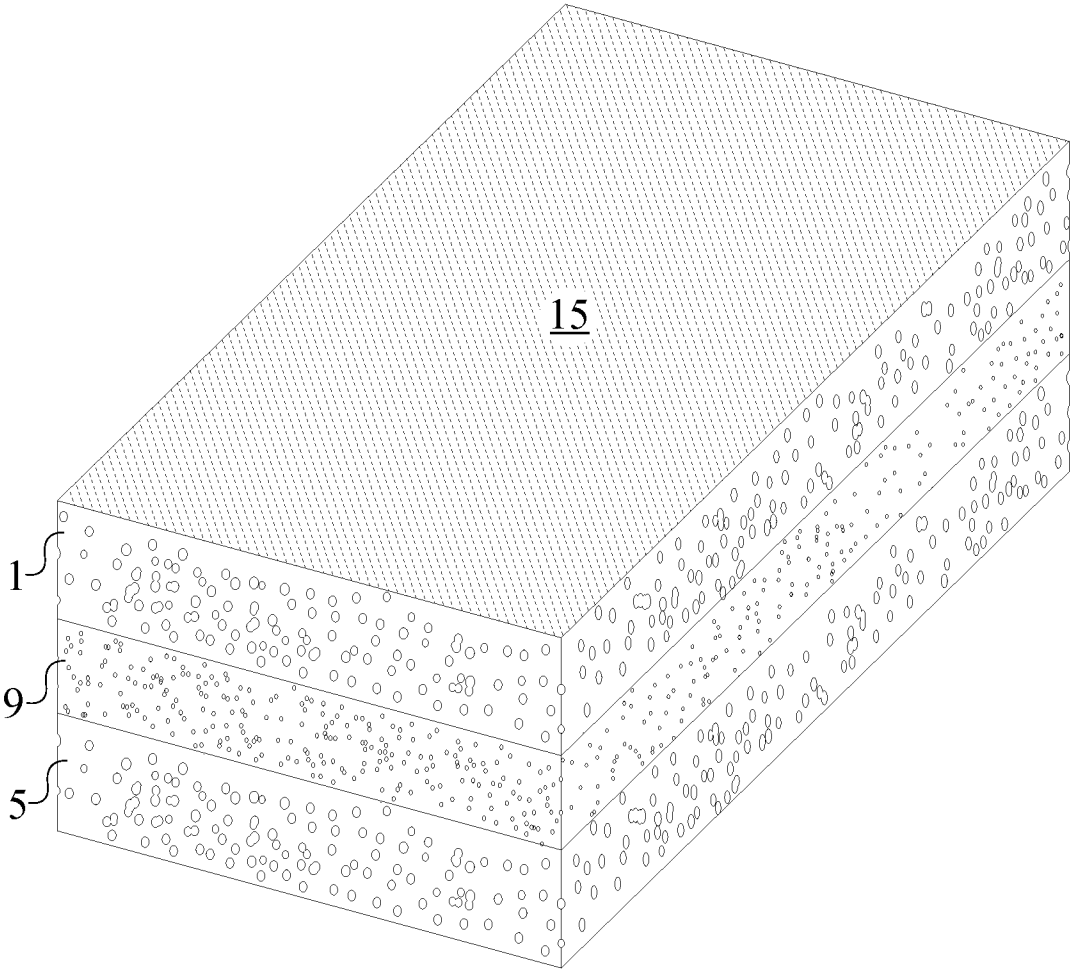
FIG. 1 is a perspective view of an embodiment of the present invention.

All illustrations of the drawings are for the purpose of describing selected versions of the present invention and are not intended to limit the scope of the present invention.

DETAILED DESCRIPTIONS OF THE INVENTION

One embodiment of the present invention is a design for a cleaning sponge. More specifically, a cleaning sponge which efficiently utilizes melamine as a surfactant to reduce the adhesion of contaminants to a substrate or surface. The embodiment includes a melamine layer serving as a detergent layer sandwiched between two polyurethane-based layers. Broadly, the detergent layer may be made of any substance or combination of substances with suitable detergent properties. The moisturizing layer hydrates the melamine layer with a liquid, for example, water; while the work layer utilizes the resultantly dissolved melamine solution to engage and clean a substrate or surface. This allows sufficient detergent solution to reach the engagement surface while at the same time reducing the mechanical impact on the melamine layer, thus increasing the longevity of the sponge. This is accomplished by varying the pore for each of the three layers of the sponge such that in static environments the liquid contained inside does not flow to the external boundaries.

In other embodiments a melamine sponge core is enclosed between two outer layers and the material of the outer layers is a flexible foam with pores (for example, polyurethane foam or foam rubber), and these pores are 3-20 larger than the pores of the melamine core, while thickness of the layers are related as 0.5-2.5-1.0-0.5-2.5.

One of the outer layers, which may have a specific color, is a moisturizing layer, and moisturizing of melamine occurs through it by placing the center of moisturizing layer under a water stream. The sponge is ready for usage when the melamine core is moisturized by capillary suction of water from the moisturizing layer. Another outer layer is a work layer, which remains almost dry because the capillary forces hold the liquid in the melamine core having significantly smaller pores than the pores of the work layer. The sponge is lightly compressed by hand, squeezing melamine solution into the work layer and treating the contaminated surface.

Since the evaporation of the liquid is difficult due to capillary forces, the sponge stays wet for a considerable time, while remaining ready to use. The only need is to add water periodically to the core through a feeding layer by the method described above.

The three-layer embodiment of the product allows to extend its functionality by making a feeding or a work layer not from elastic spongy material but from nonwoven fibrous mat with abrasive grains instead of foam material. Stiffness of the mat and grit of abrasive are determined by the purpose of the product. This layer is used for mechanical cleaning of surfaces with heavy dirt (removal of burnt grease, old paint, rust, etc.). Such mechanical cleaning assumes usage of a tool, which is dry or having minimal residual moisture.

In some embodiments the moisturizing layer may contain a reservoir with walls made, for example, of plastic. This reservoir would contain at least one opening feeding water into the detergent layer.

The pores of the outer layers should be significantly greater than pores of melamine sponge to prevent capillary suction of water accumulated in the core with dissolved melamine and reduce its subsequent evaporation. The proportions of layers' thickness may be chosen to provide their equal durability and/or equal lifetime. High elasticity of the outer work layer allows cleaning of uneven surfaces.

The glue used to connect layers may be a water-dispersion adhesive based on synthetic rubber such as chloroprene. Because adhesion of the glue to the substrate is stronger than cohesion of liquid glue, after short exposure, the solid adhesive film splits into a multitude of droplets, soak the ends of the pore walls. Thereafter, both outer layers prepared in this manner are assembled in the package with a central layer and are kept under some pressure for evaporation of water from the adhesive layers. Under the pressure applied to the assembled package, the adhesive droplets contacting the surface of the melamine sponge flatten and form a multipoint layer connection.

The permeability of the adhesive layer depends on the thickness of the glue layer and on the applied pressure when the package is dried.

Figure 2:
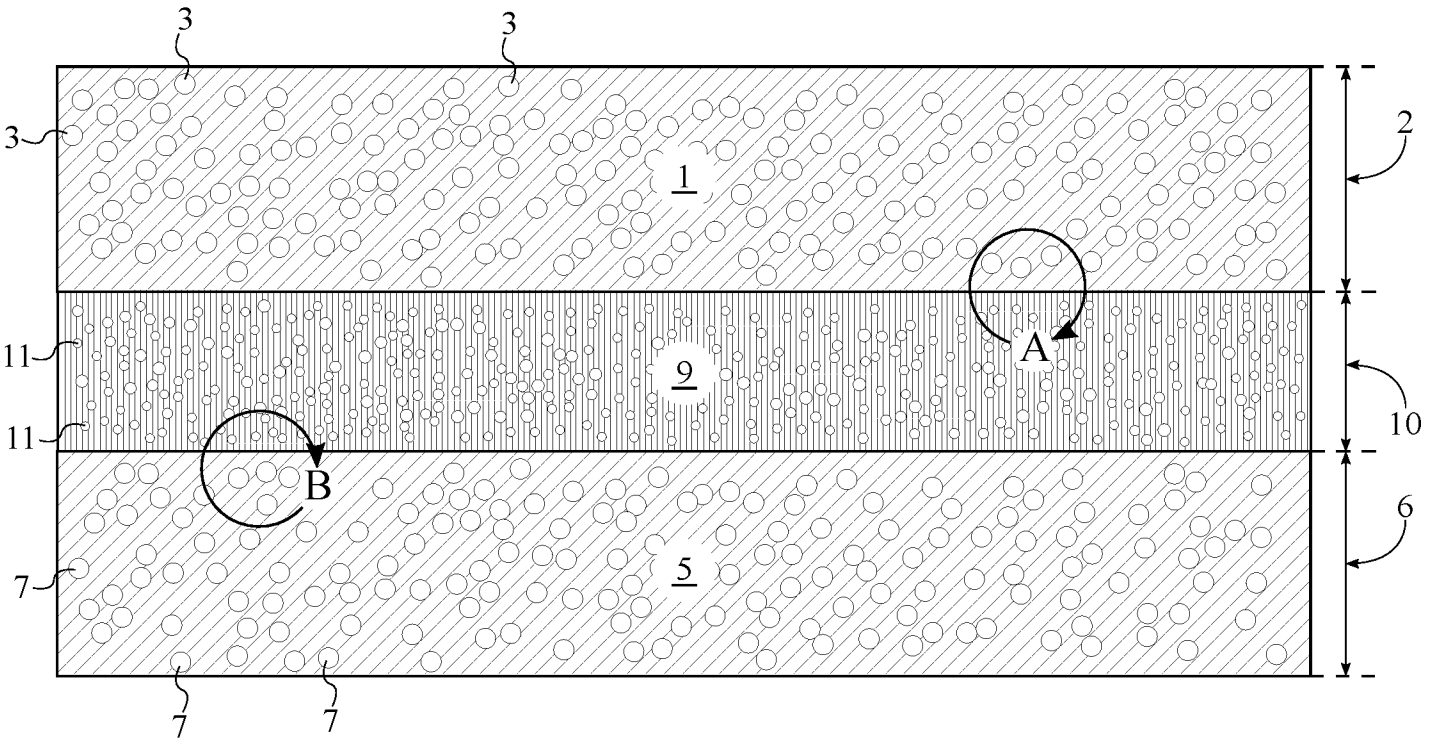
FIG. 2 is a side-view of an embodiment of the present invention.

Referring to FIG. 1 and FIG. 2, an embodiment comprises a first sponge layer 1, a plurality of first pores 3, a solidified detergent layer 9, a plurality of second pores 7, a second sponge layer 5, and a plurality of third pores 11. The first sponge layer 1 is adjacently connected across the solidified detergent layer 9 and protects the top surface of the solidified detergent layer 9 against extensive wear and tear due to mechanical agitation. The first sponge layer 1 is also used to engage and apply mechanical stress to a cleaning surface in order to remove contaminants. Similarly, the second sponge layer 5 protects the bottom surface of the solidified detergent layer 9 and as such is adjacently connected across the solidified detergent layer 9, opposite the first sponge layer 1. The second sponge layer 5 is also used to receive water from an external source and hydrate the solidified detergent layer 9. The plurality of first pores 3 is distributed throughout the first sponge layer 1 to yield a porous medium which allows liquid to flow across the first sponge layer 1. In a similar fashion, the plurality of second pores 7 is distributed throughout the second sponge layer 5 in order to allow liquid to flow across the second sponge layer 5. The solidified detergent layer 9 acts as the cleansing substance for the present embodiment. When exposed to water, a portion of the solidified detergent layer 9 dissolves and mixes with the water to create a surfactant that then may be applied to the cleaning surface through the first sponge layer 1 and the plurality of second pores 7. The solidified detergent layer 9 is preferably composed of melamine as the detergent solution formed when melamine is mixed with water is a highly effective surfactant. The plurality of third pores 11 is distributed throughout the solidified detergent layer 9 to create a porous medium, similar to the first sponge layer 1 and the second sponge layer 5. The plurality of third pores 11 allows the solidified detergent layer 9 to retain water.

Figure 3:
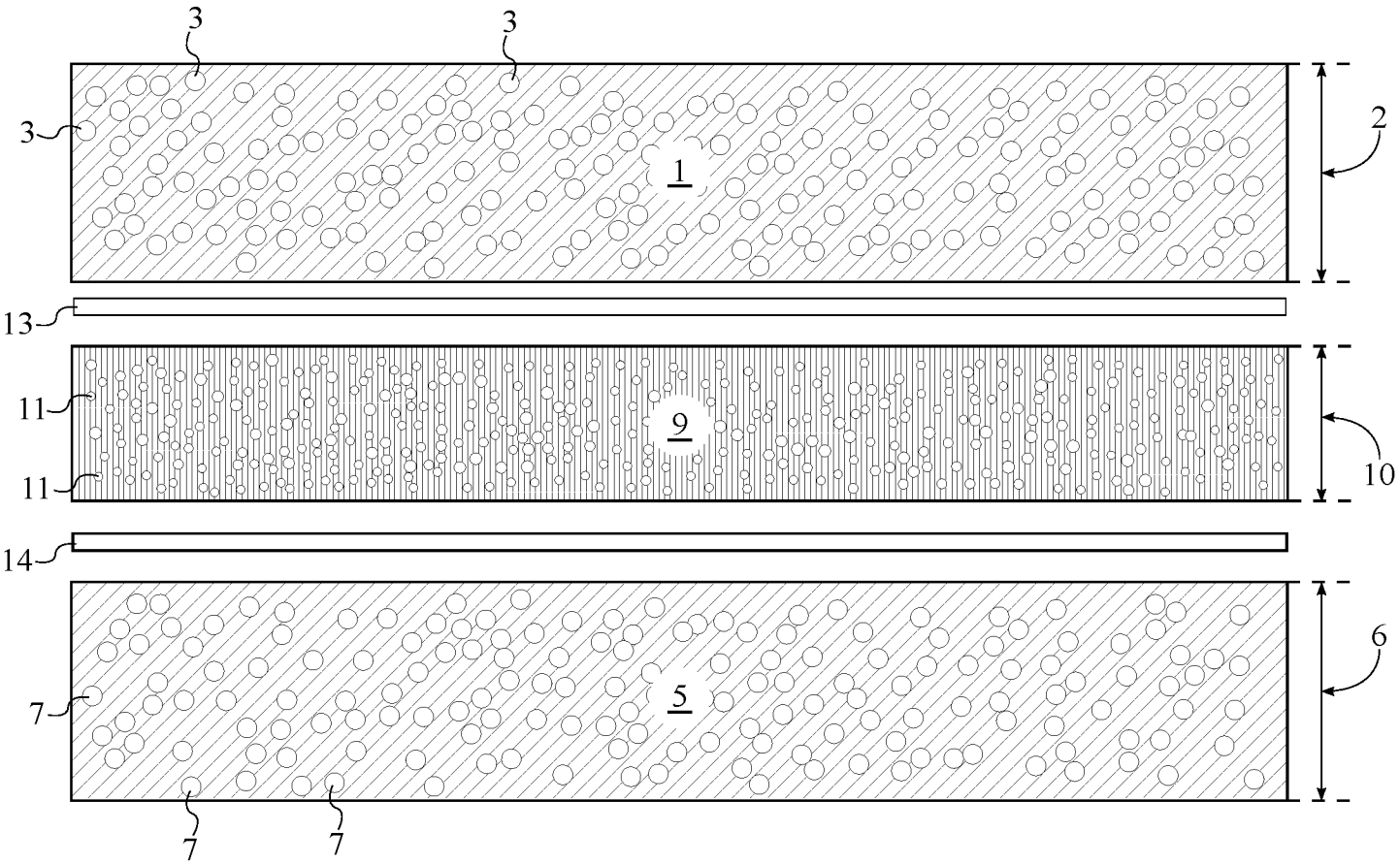
FIG. 3 is an exploded side-view of an embodiment of the present invention.
Figure 4:
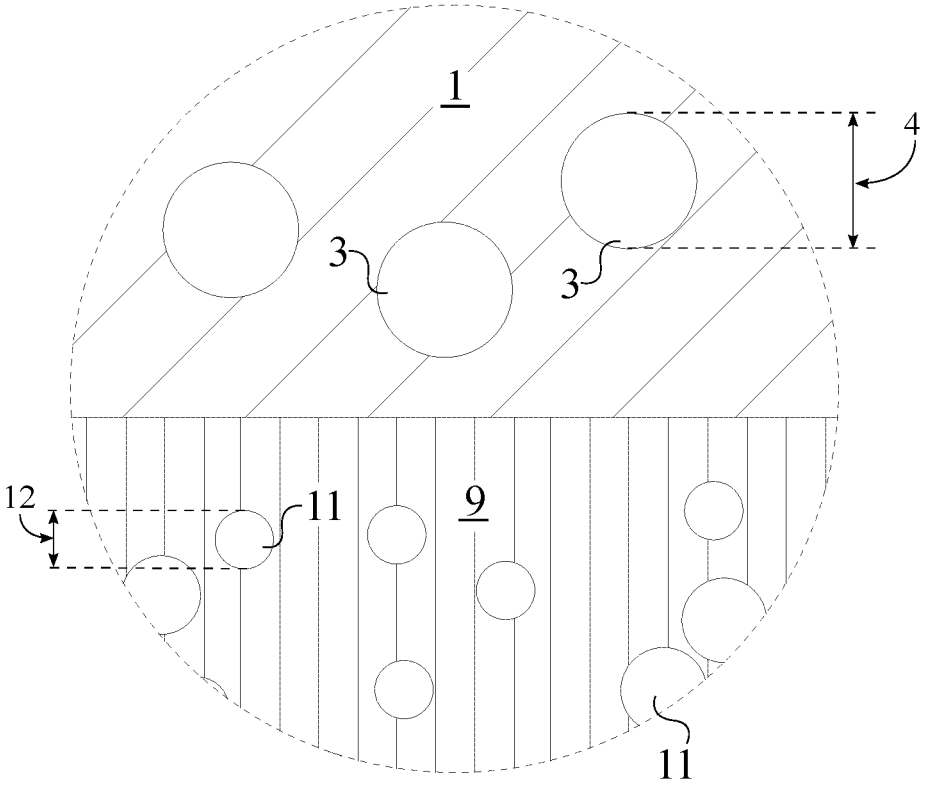
FIG. 4 is a detailed view taken about circle A in FIG. 2.
Figure 5:
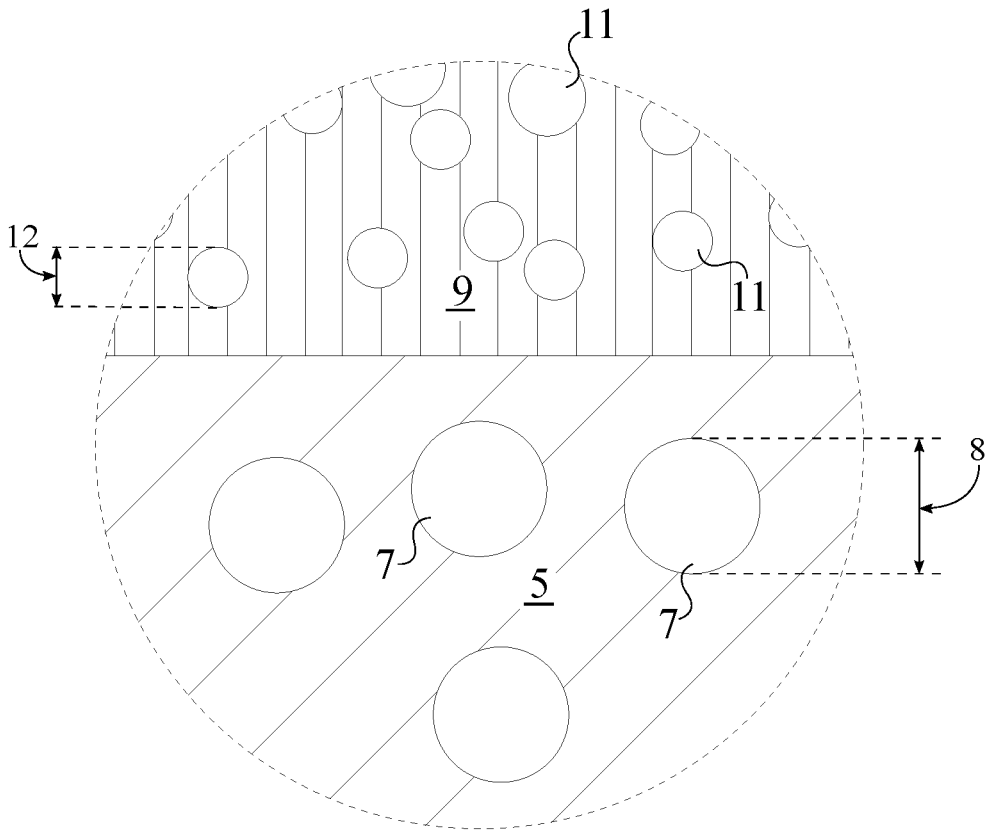
FIG. 5 is a detailed view taken about circle B in FIG. 2.
Figure 6:
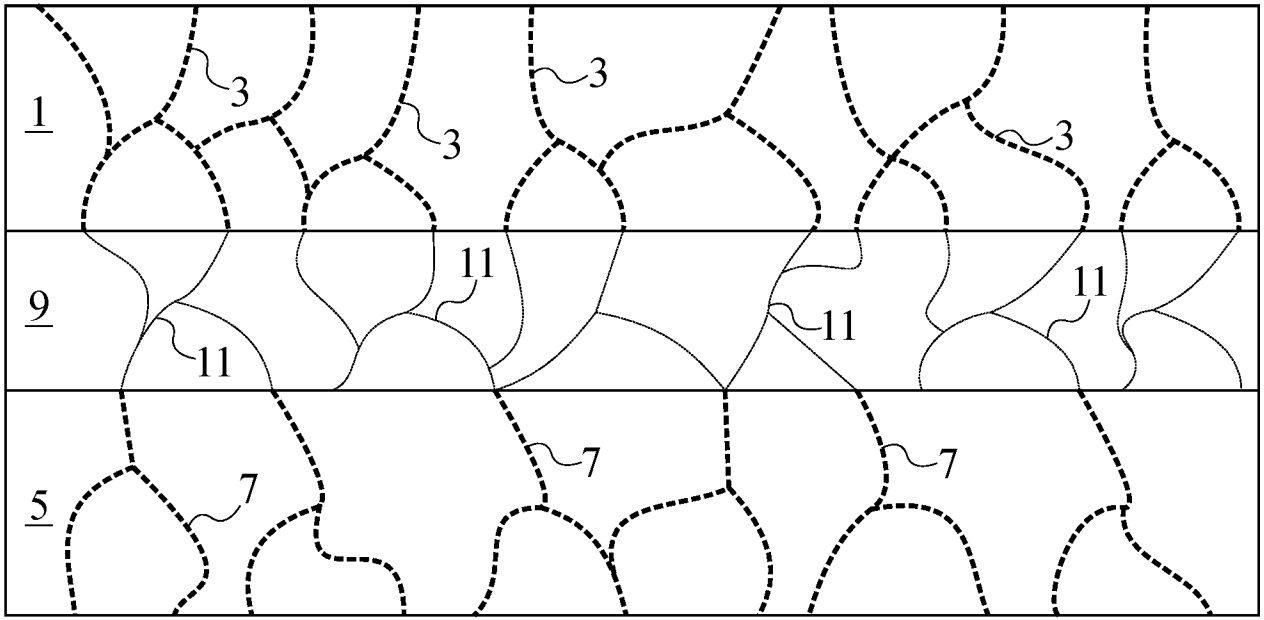
FIG. 6 is a fluid schematic view of an embodiment of the present invention depicting a plurality of first pores and a plurality of second pores being in fluid communication with each other through a plurality of third pores.

Referring to FIG. 6, the plurality of first pores 3 and the plurality of second pores 7 are in fluid communication through the plurality of third pores 11. This allows water to reach the solidified detergent layer 9 to form the detergent solution; the detergent solution may then flow out of the solidified detergent layer 9 to the exterior surface of either the first sponge layer 1 or the second sponge layer 5 in order to be used as a surfactant. When the present embodiment is not being used, it is important to retain any and all liquid within the solidified detergent to ensure a long service life. To prevent the cleaning solution from excessively leaking out of the solidified detergent layer 9, a pore size 4 for each of the plurality of first pores 3 and a pore size 8 for each of the plurality of second pores 7 are larger than a pore size 12 for each of the plurality of third pores 11 as seen in FIG. 3, FIG. 4, and FIG. 5. By making the pore size 12 of the plurality of third pores 11 relatively small in relation to the pore size 4 of the plurality of first pores and the pore size 8 of the plurality of third pores 11, the hydraulic conductivity of the solidified detergent layer 9 is resultantly lower than that of the first sponge layer 1 and the second sponge layer 5. This ensures that in static environments, when no external forces are applied to the present embodiment, the liquid contained within the solidified detergent layer 9 does not flow to either the first sponge layer 1 or the second sponge layer 5. Reducing the flow of liquid from the solidified detergent layer 9 extends the service life of the present embodiment by reducing the evaporation of the cleaning solution, wasting melamine.

In order to utilize the present embodiment, the user first pours water onto the top surface of the second sponge layer 5. This wets the second sponge layer 5 and the solidified detergent layer 9 and resultantly forms the detergent solution. Next, the user simply squeezes the present embodiment until the detergent solution begins to soak through the first sponge layer 1. Then, the present embodiment is ready to be used to clean various surfaces. It is recommended that the second sponge layer 5 stay as dry as possible.

Referring to FIG. 2 and FIG. 3, in order to accommodate various different applications a thickness 2 of the first sponge layer 1 may range between 50% of a thickness 10 of the solidified detergent layer 9 to 250% of the thickness 10 of the solidified detergent layer 9. Similarly, a thickness 6 of the second sponge layer 5 may range between 50% of the thickness 10 of the solidified detergent layer 9 to 250% of the thickness 10 of the solidified detergent layer 9. The respective dimensions are dependent on the particular application of the present embodiment. For example, industrial-type applications require a much larger thickness 2 of the first sponge layer 1 and the thickness 6 of the second sponge layer 5 relative to the thickness 10 of the solidified detergent layer 9 in order to withstand the associated mechanical stresses. Conversely, for house-related applications, the thickness 2 of the first sponge layer 1 and the thickness 6 of the second sponge layer 5 are lower in the aforementioned range as the associated mechanical stresses are relatively low. In alternative embodiments, the thickness 2 of the first sponge layer 1 and the thickness 6 the second sponge layer 5 may fall outside the aforementioned range.

In order to ensure equal wear and tear the first sponge layer 1, the second sponge layer 5 and the solidified detergent layer 9 may be coextensive. A coextensive design prevents damage to and degradation of the solidified detergent layer 9 due to excessive exposure to environmental elements and also provides a uniformed service lifetime for the constituents of such embodiments.

The solidified detergent layer 9 may also be entirely or partially surrounded by the first sponge layer 1 and/or the second sponge layer 5. For example, the first sponge layer 1 and the second sponge layer 5 may be made of the same material and the solidified detergent layer 9 may be entirely surrounded or enveloped by this material. In other embodiments, the solidified detergent layer 9 may be entirely surrounded by or contained within the work layer. In yet other embodiments, the solidified detergent layer 9 may be entirely surrounded by or contained within the moisturizing layer.

The first sponge layer 1 and the second sponge layer 5 are preferably made out of a non-woven fibrous material as the non-woven fibrous materials are flexible and are characterized by a high surface area as well as high porosity. However, the first sponge layer 1 and the second sponge layer 5 may be composed of a variety of materials including, but not limited to, polyurethane foam, foam rubber, and other similar foam-based materials. The flexible characteristic allows the present embodiment to clean hard to reach edges and to conform to various contours of tables, sinks, and other similar surfaces; resulting in a more versatile cleaning apparatus. The high surface area and high porosity characteristics allow the present embodiment to retain a large amount of liquid per area when compared to traditional sponge material composition. To further increase the mechanical stress applied to the cleaning surface, the first sponge layer 1 may also have abrasive properties. More specifically, the first sponge layer 1 may be configured with a convoluted exterior surface 15 as seen in FIG. 1. The convoluted exterior surface 15 amplifies the mechanical stress applied to the cleaning surface by the present embodiment and physically aids in dislodging dirt and other contaminants from said surface. In alternative embodiments, the second sponge layer 5 may also be configured with a convoluted exterior surface 15 for increased versatility.

To ensure that the present embodiment is durable enough to withstand cleaning processes in dry and wet conditions, the constituents of the present embodiment are attached to each other by a first adhesive layer 13 and a second adhesive layer 14 as seen in FIG. 3. The first adhesive layer 13 connects the solidified detergent layer 9 to the first sponge layer 1 and as such is positioned in between the first sponge layer 1 and the solidified detergent layer 9. In a similar fashion, the second adhesive layer 14 connects the solidified detergent layer 9 and the second sponge layer 5 and as such is positioned in between the solidified detergent layer 9 and the second sponge layer 5. It is important that the type of adhesive used is able to withstand various extreme conditions such as cold and hot water environments. In a preferred embodiment, the first adhesive layer 13 and the second adhesive layer 14 are composed of a water-based dispersion adhesive; in alternative embodiments various alternative adhesives and alternative attachment methods may be used instead. Water-based dispersion adhesives allow for the attachment of two porous mediums while still allowing liquid to flow at the junction, this is an essential characteristic for the function of the present embodiment.

The first step of the manufacturing process for the present embodiment involves coating the engagement surfaces of the first sponge layer 1 with the first adhesive layer 13. The adhesive splits into multitudes of droplets and soaks the sidewalls around the plurality of first pores 3 because the adhesion of the adhesive to the substrate, the first sponge layer 1, is stronger than the cohesion of the water-based dispersion adhesive. This step is then repeated for the second sponge layer 5 with the second adhesive layer 14. Next, the solidified detergent layer 9 is positioned in between the first sponge layer 1 and the second receiving layer, with the first adhesive layer 13 and the second adhesive layer 14 being located on either side. Next, pressure is applied in order to evaporate all water from the first sponge layer 1 and the second sponge layer 5. Simultaneously, the first adhesive layer 13 and the second adhesive layer 14 flatten and create a multipoint connection between the first sponge layer 1, second sponge layer 5, and the solidified detergent layer 9 to yield the present embodiment.

The solidified detergent layer 9 may additionally or alternatively be connected by fusion, for example, thermal fusion, to the first sponge layer 1, second sponge layer 5, or both first sponge layer 1 and second sponge layer 5. FIG. 2 illustrates an example embodiment where the layers are fused.

Although the invention has been explained in relation to its preferred embodiment, it is to be understood that many other possible modifications and variations can be made without departing from the spirit and scope of the invention as hereinafter claimed. While this invention has been particularly shown and described with references to preferred embodiments thereof, it will be understood by those skilled in the art that various changes in form and details may be made therein without departing from the scope of the invention encompassed by the appended claims.

The invention claimed is:

1. A device for cleaning of surfaces comprising:
a melamine sponge core comprising pores;
a work layer comprising pores; and
a moisturizing layer comprising pores;
wherein the work layer is a large-pore flexible sponge made, for example, of polyurethane foam or rubber foam;
wherein the pores in the work layer are connected to the pores in the melamine core;
wherein the pores in the moisturizing layer are connected to the pores in the melamine core;
wherein a size of the pores in the work layer is at least 3 times and at most 20 times greater than a size of the pores in the melamine core; and
wherein a thickness of the core is between 100% and 250% of a thickness of the work layer.

2. The device of claim 1,
wherein the moisturizing layer and the work layer are manufactured of the same material; and
wherein the moisturizing layer has a distinct color.

3. The device of claim 1,
wherein the moisturizing layer is made of a fibrous material filled with abrasive particles; and
wherein the moisturizing layer is used both for introducing water into the core and as a heavy-duty work layer.

4. The device of claim 1,
wherein the melamine sponge core is inside the moisturizing layer.

5. The device of claim 1,
wherein the melamine sponge core and the moisturizing layer are fused.

6. A device for cleaning of surfaces comprising:
a melamine sponge core comprising pores;
a work layer comprising pores; and
a moisturizing layer;
wherein the work layer is a large-pore flexible sponge made, for example, of polyurethane foam or rubber foam;
wherein the pores in the work layer are connected to the pores in the melamine core;
wherein a size of the pores in the work layer is at least 3 times and at most 20 times greater than a size of the pores in the melamine core;
wherein a thickness of the core is between 100% and 250% of a thickness of the work layer;
wherein the moisturizing layer is an integral or a separable handle made of a solid plastic comprising a water reservoir; and wherein the surface of the moisturizing layer in contact with the melamine core comprises at least one outlet for transmitting water.

7. A cleaning sponge comprising:

a detergent layer;

a plurality of detergent layer pores distributed throughout the detergent layer;

a work layer attached to the detergent layer;

a plurality of work layer pores distributed throughout the work layer;

wherein the plurality of work layer pores and the plurality of detergent layer pores are in fluid communication with each other; and wherein a pore size for each of the plurality of work layer pores is larger than a pore size for each of the plurality of detergent layer pores.

8. The cleaning sponge of claim 7, wherein the detergent layer comprises melamine.

9. The cleaning sponge of claim 7, wherein a pore size for each of the plurality of work layer pores is at least three times larger than a pore size for each of the plurality of detergent layer pores.

10. The cleaning sponge of claim 7, wherein the work layer comprises non-woven fibrous material.

11. The cleaning sponge of claim 7, wherein the work layer comprises polyurethane, polyurethane foam, or rubber foam.

12. The cleaning sponge of claim 7, wherein the work layer is abrasive or comprises abrasive particles.

13. The cleaning sponge of claim 7, wherein the work layer comprises a convoluted exterior surface.

14. The cleaning sponge of claim 7, wherein the work layer is flexible.

15. The cleaning sponge of claim 7, wherein a thickness of the detergent layer is from 100% to 250% of a thickness of the work layer.

16. The cleaning sponge of claim 7, further comprising a first plurality of adhesive droplets between the detergent layer and the work layer.

17. The cleaning sponge of claim 7, further comprising a moisturizing block attached to the detergent layer opposite the work layer;

wherein the moisturizing block is capable of storing fluid; and wherein the moisturizing block and the plurality of work layer pores are in fluid communication through the plurality of detergent pores.

18. The cleaning sponge of claim 17, wherein the moisturizing block comprises a fluid reservoir;

wherein a surface of the moisturizing block facing the detergent layer comprises at least one fluid outlet capable of transmitting fluid from the fluid reservoir; and wherein the fluid outlet and the plurality of work layer pores are in fluid communication through the plurality of detergent pores.

19. The cleaning sponge of claim 17, wherein the moisturizing block comprises a plurality of moisturizing block pores distributed throughout the moisturizing block;

wherein the plurality of moisturizing block pores and the plurality of work layer pores are in fluid communication through the plurality of detergent pores.

20. The cleaning sponge of claim 19, wherein a pore size for each of the plurality of moisturizing block pores is larger than a pore size for each of the plurality of detergent pores.

21. The cleaning sponge of claim 17, wherein the work layer comprises polyurethane, polyurethane foam, or rubber foam.

22. The cleaning sponge of claim 17, wherein the moisturizing block and the work layer have different visual appearance.

23. The cleaning sponge of claim 17, further comprising a second plurality of adhesive droplets between the detergent layer and the moisturizing block.

24. The cleaning sponge of claim 17, wherein the moisturizing block is abrasive or comprises abrasive particles.

25. The cleaning sponge of claim 7, wherein the detergent layer is inside the work layer.

26. The cleaning sponge of claim 7, wherein the detergent layer and the work layer are fused.

* * * * *